US006053879A

United States Patent [19]

Leban et al.

[11] Patent Number: 6,053,879

[45] Date of Patent: Apr. 25, 2000

[54] PULMONARY THERAPY DEVICE AND METHOD

[75] Inventors: Stanley Leban, Islandia; Gregg E. Gordon, Katonah, both of N.Y.

[73] Assignee: Millennium Devices, L.L.C., Islandia, N.Y.

[21] Appl. No.: 09/237,702

[22] Filed: Jan. 26, 1999

[51] Int. Cl.[7] ..... A63B 22/00

[52] U.S. Cl. ..... 601/15; 601/47

[58] Field of Search ..... 601/1, 2, 15, 16, 601/46–49; 607/1, 2, 4, 115

[56] References Cited

U.S. PATENT DOCUMENTS

| | | | |
|---|---|---|---|
| 4,538,596 | 9/1985 | Colasante . | |
| 4,745,910 | 5/1988 | Day et al. . | |
| 4,753,225 | 6/1988 | Vogel . | |
| 5,035,235 | 7/1991 | Chesky | 601/47 |
| 5,086,755 | 2/1992 | Schmid | 601/47 |
| 5,113,852 | 5/1992 | Murtonen | 601/47 |
| 5,261,422 | 11/1993 | Kelly | 600/548 |
| 5,453,081 | 9/1995 | Hansen . | |
| 5,569,170 | 10/1996 | Hansen . | |
| 5,606,754 | 3/1997 | Hand et al. | 5/713 |
| 5,895,348 | 4/1999 | Hosaka | 600/27 |

*Primary Examiner*—Glenn E. Richman
*Attorney, Agent, or Firm*—Collard & Roe, P.C.

[57] ABSTRACT

A method and device for administering pulmonary physical therapy to a patient. The device comprises a control console comprising a sound generator for generating sounds, and a patient contact board. The control console has knobs for adjusting the frequency, wavelength, duration and volume of the sounds from the sound generator, and a power cord for connecting the control console to a power source. The patient contact board is connected to the control console. The contact board has a plurality of speakers mounted on the front face of the board and connected to said sound generator for transmitting the sounds generated by said sound generator. There is a soundproof lining along the back face of the board. The method involves holding the board to the patient's chest or having the patient lean against the board and administering low frequency sound waves to the patient's chest via the control console to loosen chest secretions.

3 Claims, 1 Drawing Sheet

PULMONARY THERAPY DEVICE AND METHOD

BACKGROUND OF THE INVENTION

1. Field of the Invention

This invention relates to a method and device for administering pulmonary therapy. In particular, this invention relates to a device that administers acoustic waves to break up secretions in a patient's lungs.

2. The Prior Art

It is often necessary to administer pulmonary physical therapy in order to prevent atelectasis, poor pulmonary ventilation, and pneumonia. Chest percussion via "clapping" is often used to promote postural drainage. Clapping generates asacoustic shock waves that vibrate the lung tissue and loosen accumulated secretions. This technique has several disadvantages, however. Clapping can be very uncomfortable to the patient due to the impact of the therapist's hand or the percussor against the patient's chest. Clapping can also cause physical damage including broken ribs in predisposed patients, such as the elderly. Furthermore, this technique requires the time and energy of a skilled therapist and is consequently very expensive.

It would therefore be desirable to devise an instrument that can mobilize airway secretions without pain, physical trauma to the chest wall or the expense of a trained therapist.

Electronically generated acoustic waves have been used in the medical field for treatment of various disorders. For example, U.S. Pat. No. 4,538,596 to Colasante discloses a method of using low frequency sound to reduce adhesions in postoperative sites. U.S. Pat. No. 4,753,225 to Vogel discloses a device for provide acoustic irradiation to the body. The device is devised to be sat on by the patient and treats various organs of the body. U.S. Pat. No. 5,435,304 to Oppelt et al. discloses another therapy device that administers acoustic waves to a patient for treating various medical problems. U.S. Pat. Nos. 5,453,081 and 5,569,170 to Hanson disclose a vest or mattress that delivers air pressure pulses to the patient to assist in the patient's lung functions. None of these devices are suitable for administering pulmonary physical therapy in a simple and effective manner.

SUMMARY OF THE INVENTION

It is therefore an object of the invention to provide a device for administering pulmonary physical therapy using acoustic waves.

It is another object of the invention to provide a device for administering pulmonary physical therapy that is safe and comfortable for the patient.

It is another object of the invention to provide a device for administering pulmonary physical therapy that is simple and convenient to use.

These and other objects are accomplished by a device for administering pulmonary physical therapy comprising a control console having a sound generator for generating sounds, and a patient contact board. The control console has knobs for adjusting the frequency, wavelength, duration and volume of the sounds from the sound generator, and a power cord for connecting the control console to a power source. The patient contact board is connected to the control console via a flexible cable. The contact board has a plurality of small speakers mounted on the front face of the board and connected to the sound generator for transmitting the sounds generated by said sound generator. The speakers are preferably arranged in parallel rows and columns on the board.

There is a soundproof lining along the back face of the board to prevent noise and vibrations from being transmitted through the back of the board.

The patient is treated by holding the board to the patient's chest and administering low frequency sound waves to the patient's chest via the control console to loosen chest secretions.

The sound generator can be a synthesizer or a digital sound loop, or any other suitable mechanism for generating low frequency sound waves. The control console preferably has a series of control knobs for adjusting the frequency, wavelength, duration and amplitude of the sound waves. The sound waves penetrate the lung tissue and set up vibrations capable of loosening mucus and other airway secretions. The device could also stimulate a cough reflex to aid in clearing the loosened secretions. The patient could either lie on or lean against the board for the treatment.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
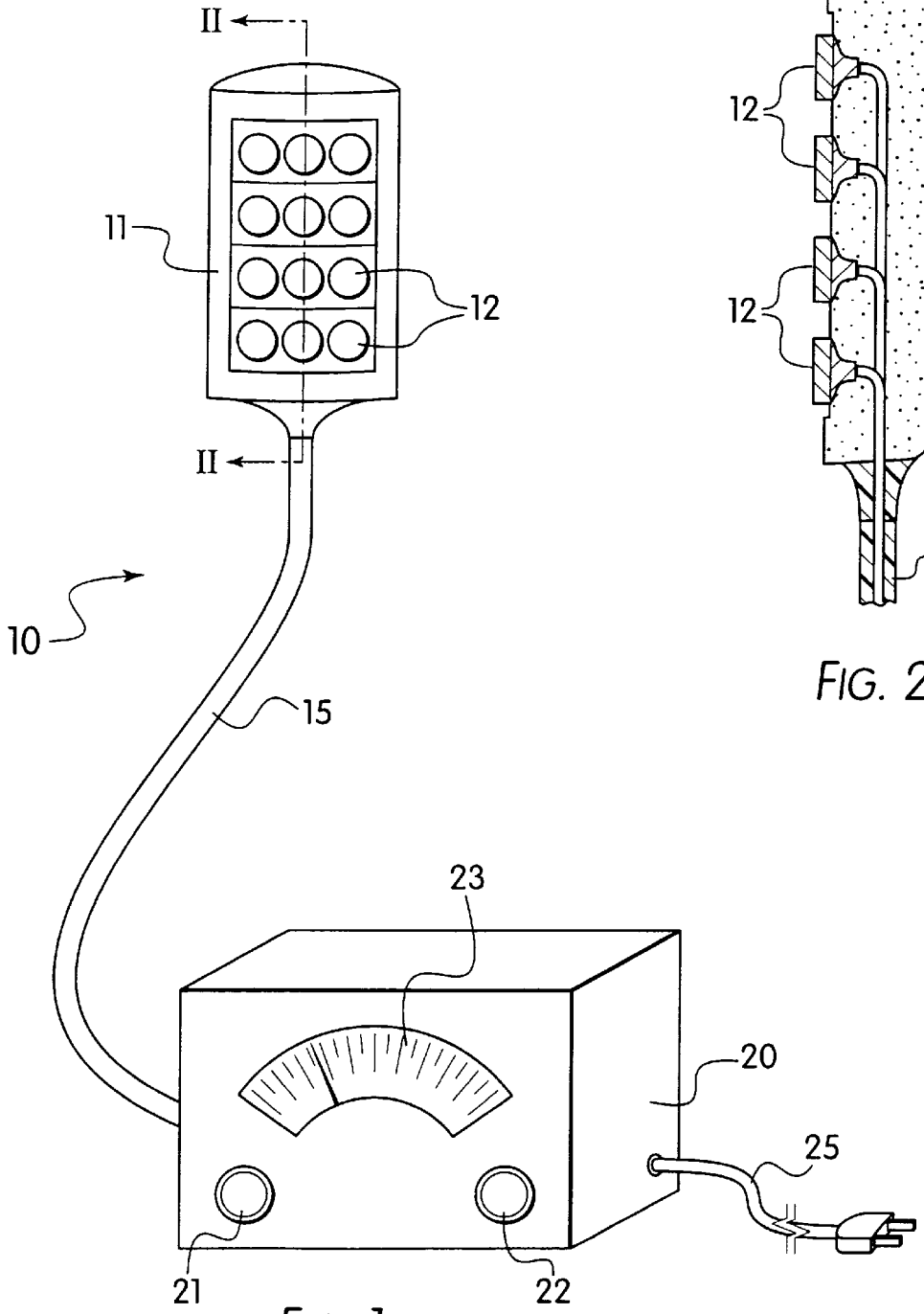
FIG. 1 shows a perspective view of the device according to the invention.
Figure 2:
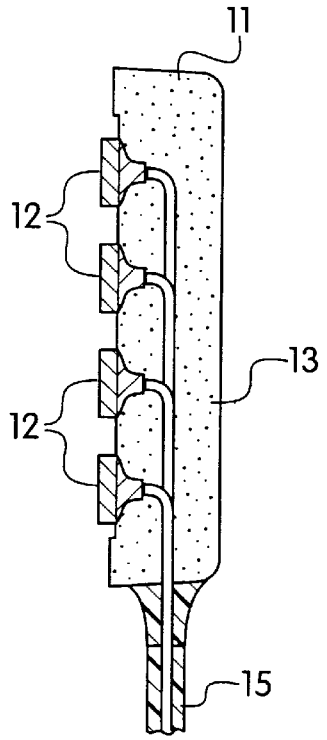
FIG. 2 shows a cross-sectional view along lines II—II of the patient contact board shown in FIG. 1.

Referring now in detail to the drawings, FIGS. 1 and 2 show the device 10 according to the invention, which comprises a control console 20 connected by a cable 15 to a patient contact board 11. Contact board 11 is comprised of a sound insulating backing 13 into which a plurality of speakers 12 are mounted. Each speaker 12 is connected to cable 15.

Control console 20 has an electrical connection 25 to power console 20. Console 20 is a sound generator that is capable of transmitting low frequency sound waves through a speaker. These types of generators are well known and are therefore not discussed in detail here. Console 20 also has a volume control 21 and a frequency/wavelength control 22. Dial 23 indicates the amount of volume and thus percussive force being transmitted through speakers 12. The technician operating device 10 can thus easily adjust the type of acoustic energy being transmitted to the patient.

In use, patient contact board 11 is held against the patient's chest or is placed underneath the patient. The technician adjusts knobs 21 and 22 on console 20 until the desired amount of acoustic energy is transmitted through speakers 12. This acoustic energy penetrates the patient's chest and loosens secretions in the patient's lungs. The treatment progresses for as long as the technician deems appropriate, at which point the patient contact board is removed from the patient.

Accordingly, while only a single embodiment of the present invention has been shown and described, it is obvious that many changes and modifications may be made thereunto without departing from the spirit and scope of the invention.

What is claimed is:

1. A device for administering pulmonary physical therapy to a patient by mobilizing lung secretions, comprising:

a control console comprising:

a sound generator for generating low frequency acoustic waves:

means for adjusting at least one of the frequencies, wavelengths, duration and volume of the acoustic waves from the sound generator; and means for connecting the control console to a power source; and a patient contact board connected to the control console via a flexible cable and having a front face and a back face and comprising:

a plurality of speakers mounted on the front face of the board, each of said speakers being connected to said sound generator for transmitting the acoustic waves generated by said sound generator; and a soundproof lining along the back face of the board for preventing the acoustic waves from being transmitted through the back face of the board.

2. The device according to claim 1, wherein the sound generator is a digital synthesizer.

3. The device according to claim 1, wherein the speakers are arranged in parallel rows and columns on the patient contact board.

* * * * *